US005429353A

United States Patent [19]

Hoeflich

[11] Patent Number: 5,429,353

[45] Date of Patent: Jul. 4, 1995

[54] GOLF CLUB IRONS AND METHOD OF MANUFACTURE OF IRON SETS

[75] Inventor: John B. Hoeflich, South Dartmouth, Mass.

[73] Assignee: Acushnet Company, Fairhaven, Mass.

[21] Appl. No.: 100,839

[22] Filed: Jul. 30, 1993

[51] Int. Cl.[6] ..... A63B 53/04

[52] U.S. Cl. ..... 273/77 A; 273/167 H; 273/167 F; 273/169

[58] Field of Search ..... 273/167 R, 167 A, 167 B, 273/167 C, 167 D, 167 E, 167 F, 167 G, 167 H, 167 J, 167 K, 168, 169, 170, 171, 172, 173, 174, 175, 78, 77 R, 186.2, 187.4, 164.1, 193 R, 194 R, 77 A; D21/220

[56] References Cited

U.S. PATENT DOCUMENTS

| | | | |
|---|---|---|---|
| 4,322,083 | 3/1982 | Imai | 273/167 F |
| 4,715,601 | 12/1987 | Lamanna | 273/169 X |
| 4,848,747 | 7/1989 | Fujimura | 273/77 A |
| 4,854,580 | 8/1989 | Kobayashi | 273/77 A |
| 4,938,470 | 7/1990 | Antonious | 273/164.1 |
| 4,986,541 | 1/1991 | Teramoto | 273/77 A |
| 5,026,056 | 6/1991 | McNally | 273/169 X |
| 5,046,733 | 9/1991 | Antonious | 273/77 A |

FOREIGN PATENT DOCUMENTS

| | | | |
|---|---|---|---|
| 2117254 | 10/1983 | United Kingdom | 273/77 A |
| 2194737 | 3/1988 | United Kingdom | 273/77 A |

*Primary Examiner*—Sebastiano Passaniti
*Attorney, Agent, or Firm*—Pennie & Edmonds

[57] ABSTRACT

The set of irons have a cavity back surrounded by a perimeter where the perimeter is formed such that the geometric center or other intended impact position on the club face and the center of gravity of the club head coincide.

5 Claims, 4 Drawing Sheets

GOLF CLUB IRONS AND METHOD OF MANUFACTURE OF IRON SETS

This invention relates to golf clubs and, more particularly, to irons having a back cavity where the perimeter outside the back cavity is varied such that the geometric center of the face of the club head coincides with the center of gravity of the club head.

Golf clubs comprise a shaft and a club head and are generally classified into three categories: woods, irons and putters. Irons are classified by loft angle. Irons with low loft angles, e.g. 20°–30°, are classified as long irons while irons with large loft angles, e.g. 40°–50°, are classified as short irons. Typically, irons are numbered from long to short, i.e. 1, 2, 3, 4, 5, 6, 7, 8, 9, PW (pitching wedge), SW (sand wedge), and LW (lob wedge).

The club head of an iron has a face, for hitting the golf ball, and a back. The back may have either a cavity or a smooth surface. Each face has an area referred to as a sweet spot. The sweet spot is that area on the face of a club head which, when it impacts a golf ball, provides the most favorable results. Cavity back irons have larger sweet spots than solid back irons. There have been suggestions to vary the size and position of the back cavity; see U.S. Pat. Nos. 4,715,601 issued Dec. 29, 1987 and 4,848,747 issued Jul. 18, 1989. Varying the position of the center of gravity from club to club within a set has been suggested (U.S. Pat. No. 5,160,136). However, none of these references teach the achieving of aligning the geometric center of the face of an iron with the center of gravity of the club head by varying the perimeter weight of the back of the club head.

It has now been discovered that an exceptionally playable cavity back iron can be made by adjusting the perimeter weighting outside the cavity in the back of the iron so that the center of gravity of the club head and the geometric center of the face of the club head coincide.

According to the present invention it is important that the weight adjustment be in the perimeter of the club head and not in the cavity itself. This achieves better heel-toe balance than can be achieved by adjusting the weight in the cavity itself. It is especially desirable to maintain a flat cavity bottom. This can be achieved by maintaining a constant distance between the face and the cavity bottom throughout a substantial portion of the cavity.

In addition to adjusting the perimeter weight in the back of the club head, the hosel length of the irons is maintained at substantially the same length, preferably within +/−0.01 inch and most preferably +/−0.005 inch, while the ratio of the overall percentage of the club weight in the toe and sole is greater in the short irons than in the long irons.

The geometric center of the face is located by finding the mid-point of the blade length along the sole and moving upward a distance about equal to the radius of a golf ball, from about ½ inch to about 1 inch (about 1.3 to about 2.5 cm). More preferably, the geometric center of the face is located about 0.8–0.9 inch (about 2.0–2.3 cm) up from the mid-point of the blade as measured along the sole.

In order to produce an iron in accordance with the present invention, it is preferred that the offset of the club heads be greater in the long irons than in the short irons, preferably decreasing progressively from long irons to short irons. As is well known to those in the art, offset is the distance from a plane tangent to the front of the hosel parallel to the leading edge of the club to the leading edge. The progression of offset from the long to the short irons contributes to the performance of the iron. In long irons the larger offset helps keep the players' hands ahead of the ball at impact and promotes a steep angle of attack to get the ball airborne more quickly.

The bounce angle is also preferably varied. As is well known to those in the art, bounce angle is the distance between the ground and the line which connects the leading edge of the sole with the trailing, or effective trailing, edge of the sole. Preferably, the longer irons have a negative bounce angle while the middle irons have a neutral bounce angle and the shorter irons have a positive bounce angle. The bounce angle helps improve playability, launch angle and spin rate.

These and other aspects of the present invention may be more fully understood by reference to the following drawings.

Figure 1:
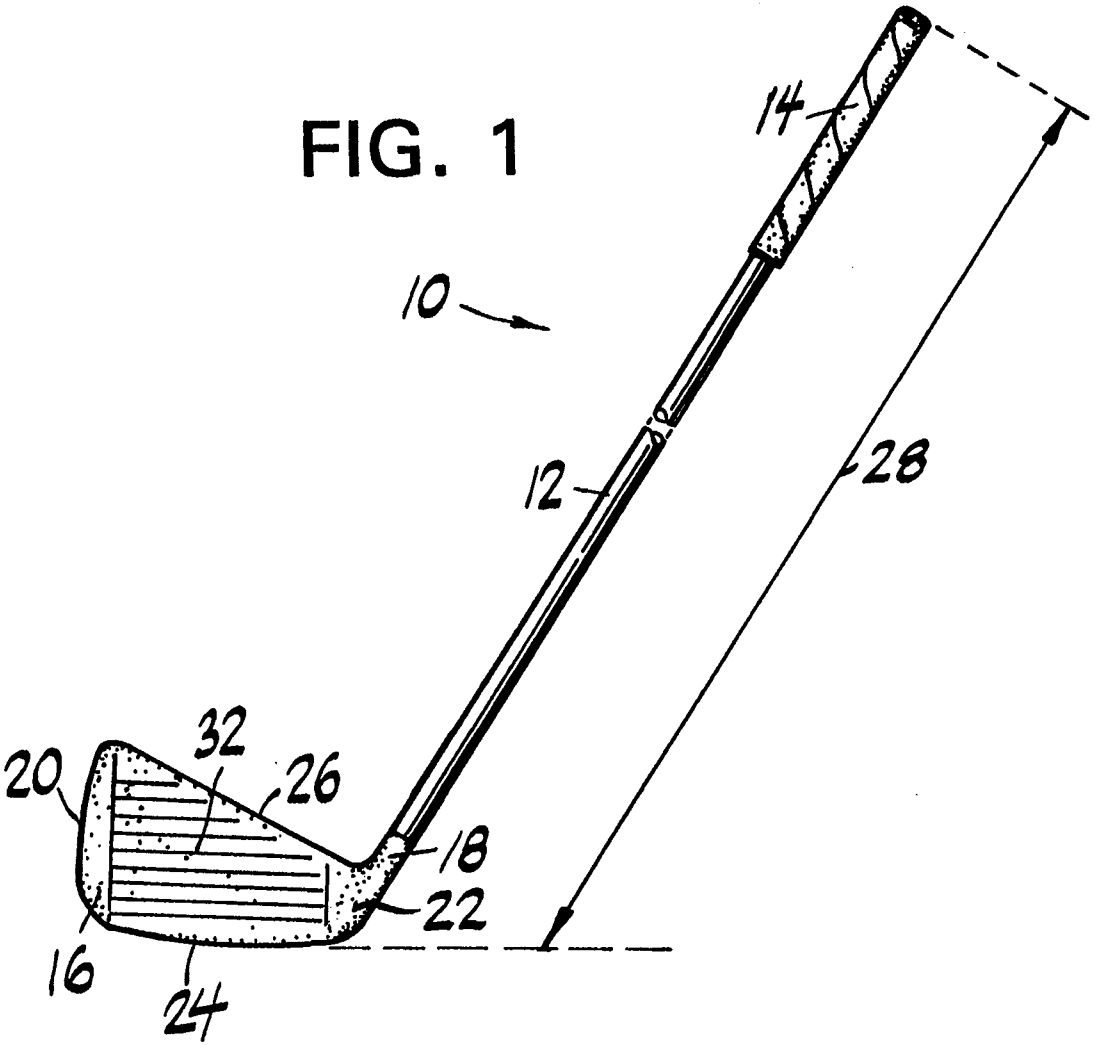
FIG. 1 is a preferred iron in accordance with the present invention.

FIG. 1 illustrates iron 10. Iron 10 comprises shaft 12 with grip 14 and head 16. Head 16 is connected by hosel 18 to shaft 12 in conventional manner. Similarly, grip 14 is attached to shaft 12 in conventional manner. Head 16 comprises toe 20, heel 22, sole 24 and top 26. Finished club height 28 is also illustrated. Finished club height 28 progressively decreases from long irons to short irons as is conventional. Front face 32 is suitably scored with grooves in conventional manner.

Figure 2:
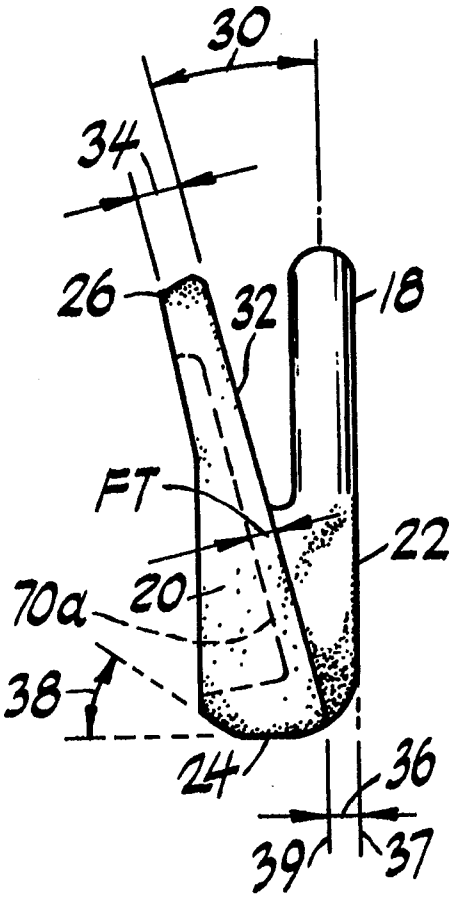
FIG. 2 is a side view of a preferred club head in accordance with the present invention.

FIG. 2 illustrates a side view of a club head. Loft angle 30 is the angle between the center line of the hosel 18 and the club head face 32. Face thickness (FT) is the distance between face 32 and cavity bottom 70*a*. Top line thickness 34 is the thickness of the top of the club head from the face to the back of the club head. Preferably, top line thickness is uniform across the top of the club head for each of the clubs. Offset 36 is the parallel distance from the plane 37 tangent to the front of hosel 18 to the leading edge 39 of face 32. Preferably, the offset progressively decreases from the long irons to the short irons. Bounce angle 38 is also depicted. It is also preferred that the bounce angle increases from long irons to short irons.

Figure 3:
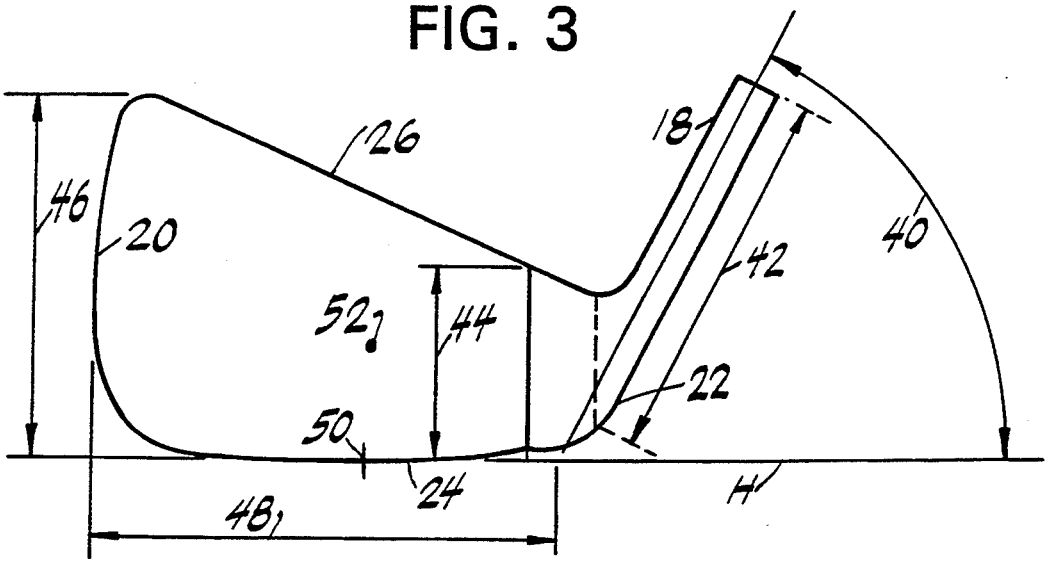
FIG. 3 is a front view of a preferred club head in accordance with the present invention.

FIG. 3 illustrates the front of a club head which has not been scored. Lie angle 40 is shown, along with hosel length 42, par height 44, toe height 46, and blade length 48. Mid-point 50 of blade length 48 is also shown. Although not necessarily to scale, the location of the geometric center of the club head face is shown as 52. The geometric center is about a golf ball's radius up from sole 24. Preferably, geometric center 52 is about 1.0 to about 0.5 inches (2.5 to 1.3 cm) measured vertically from sole 24. More preferably, it is about 0.9 inches (2.3 cm) from sole 24.

Figure 4:
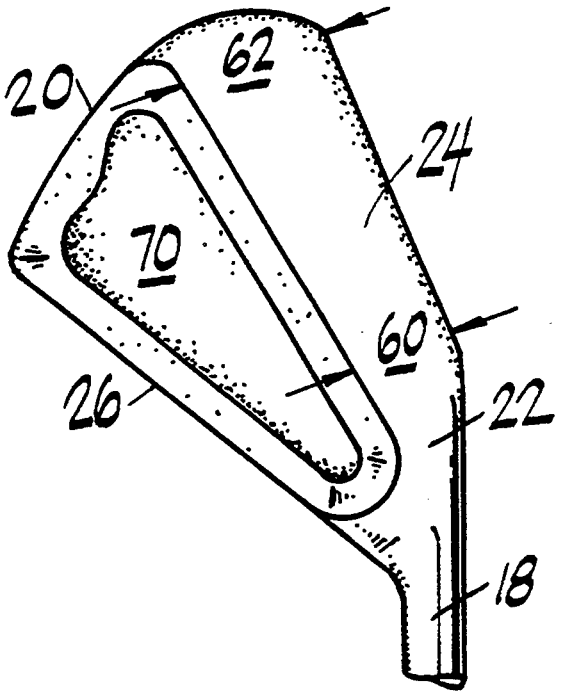
FIG. 4 is a bottom view of a preferred club head in accordance with the present invention.

FIG. 4 illustrates sole 24 of a club head with heel sole width 60 and toe sole width 62. Cavity 70 is shown in the back of the club head.

Figure 5:
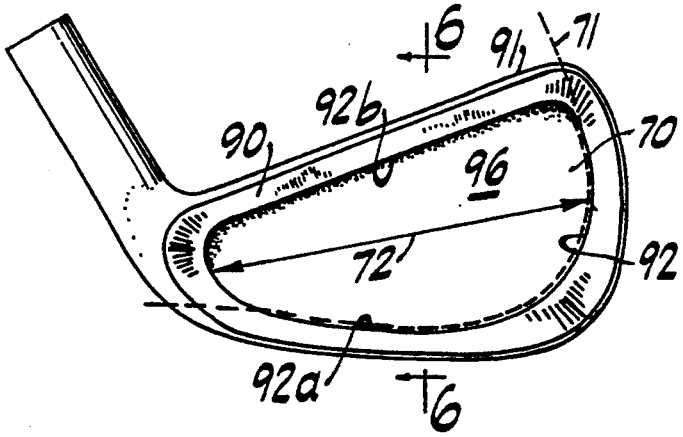
FIG. 5 is a back view of a club head as embodied in a 2 iron.
Figure 6:
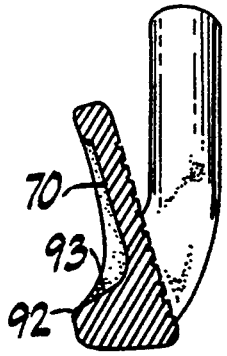
FIG. 6 is a section view of FIG. 5 of a club head as embodied in a 2 iron.
Figure 7:
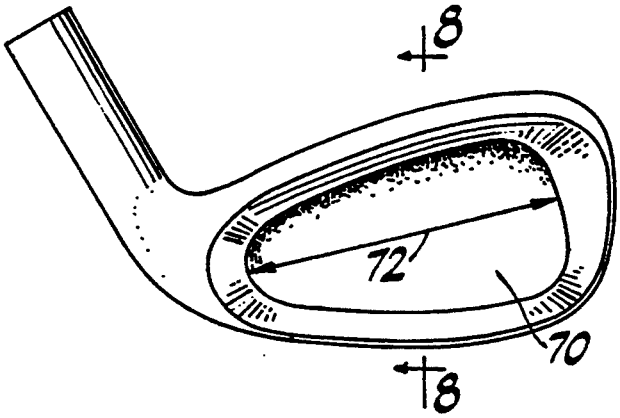
FIG. 7 is a back view of a club head as embodied in an 8 iron.
Figure 8:
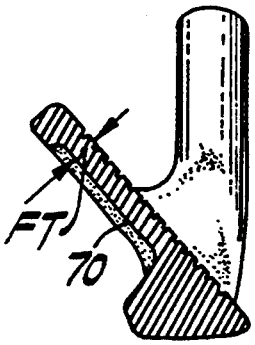
FIG. 8 is a section view of FIG. 7 of a club head as embodied in an 8 iron.
Figure 9:
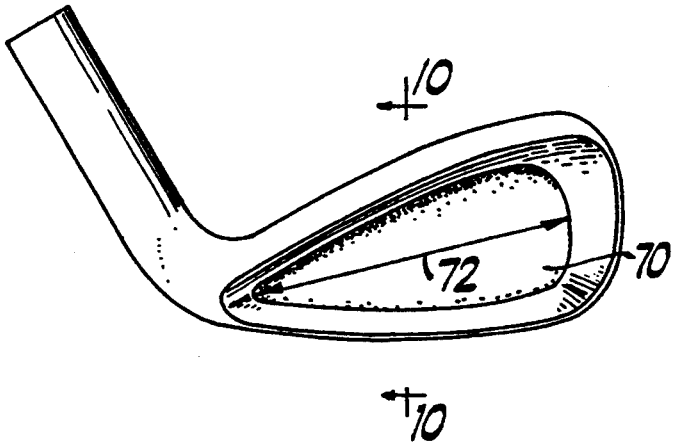
FIG. 9 is a back view of a club head as embodied in a pitching wedge.
Figure 10:
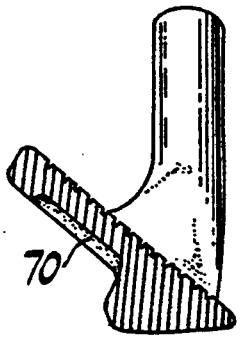
FIG. 10 is a section view of FIG. 9 of a club head as embodied in a pitching wedge.

FIG. 5 illustrates the cavity back of a number 2 iron, while FIG. 7 illustrates the cavity back of a number 8 iron, and FIG. 9 illustrates the cavity back of a pitching wedge (PW). FIGS. 6, 8 and are side views of the respective irons illustrated in FIGS. 5, 7 and 9 along the center lines as shown. In each of FIGS. 5–10, cavity 70 is illustrated. The longest dimension 72 of the cavity is also shown.

For a preferred set of irons made in accordance with the present invention, the following dimensions are provided:

TABLE A-1

| | | | Elements | | | |
|---|---|---|---|---|---|---|
| Iron | (30) Loft Angle (deg) | (40) Lie angle (deg) | (36) Offset (in) | (38) Bounce angle (deg) | (42) Hosel Length (in) | (48) Blade Length (in) |
| 1 | 16 | 56 | .386 | −3 | 2.65 | 3.0 |
| 2 | 18 | 57 | .363 | −3 | 2.67 | 3.0 |
| 3 | 21 | 58 | .330 | −2 | 2.66 | 3.0 |
| 4 | 24.5 | 59 | .293 | −2 | 2.67 | 3.0 |
| 5 | 28 | 60 | .257 | −1 | 2.67 | 3.0 |
| 6 | 32 | 61 | .218 | −1 | 2.72 | 3.0 |
| 7 | 36 | 61.5 | .181 | 0 | 2.72 | 3.0 |
| 8 | 40 | 62 | .144 | +1 | 2.70 | 3.0 |
| 9 | 44 | 62.5 | .109 | +2 | 2.70 | 3.0 |
| PW | 48 | 63 | .095 | +4 | 2.75 | 3.0 |
| W | 52 | 63 | .095 | +4 | 2.75 | 3.0 |
| SW | 56 | 63 | +.010 | +10 | 2.72 | 3.0 |
| LW | 60 | 63 | +.010 | +8 | 2.70 | 3.0 |

TABLE A-2

| | | Elements | | | |
|---|---|---|---|---|---|
| Iron | (34) Top Line Thickness (in) | (62) Toe Sole Width (in) | (60) Heel Sole Width (in) | Head Weight (gram) | (28) Finished Club Length (in) |
| 1 | 0.27 | .885 | .590 | 235 | 39.5 |
| 2 | 0.27 | .910 | .605 | 242 | 39 |
| 3 | 0.27 | .910 | .605 | 247 | 38.5 |
| 4 | 0.27 | .920 | .640 | 253 | 38 |
| 5 | 0.27 | .925 | .640 | 260 | 37.5 |
| 6 | 0.27 | .925 | .650 | 267 | 37 |
| 7 | 0.27 | .940 | .680 | 274 | 36.5 |
| 8 | 0.27 | .940 | .680 | 282 | 36 |
| 9 | 0.27 | .990 | .695 | 286 | 35.625 |
| PW | 0.27 | 1.040 | .725 | 289 | 35.5 |
| W | 0.27 | 1.040 | .730 | 293 | 35.5 |
| SW | 0.27 | 1.060 | .810 | 292 | 35.5 |
| LW | 0.27 | 1.060 | .800 | 291 | 35.5 |

TABLE A-3

| | Elements | |
|---|---|---|
| Iron | (72) Cavity Volume ($in^3$) | % Club Weight in Combined Toe and Sole |
| 1 | 0.6 | 50 |
| 2 | 0.65 | 52 |

TABLE A-3-continued

| | Elements | |
|---|---|---|
| Iron | (72) Cavity Volume ($in^3$) | % Club Weight in Combined Toe and Sole |
| 3 | 0.55 | 50 |
| 4 | 0.58 | 52 |
| 5 | 0.48 | 53 |
| 6 | 0.44 | 56 |
| 7 | 0.4 | 56 |
| 8 | 0.47 | 57 |
| 9 | 0.35 | 57 |
| PW | 0.35 | 57 |
| W | — | 57 |
| SW | 0.32 | 57 |
| LW | — | 57 |

TABLE B-1

| | | | Club Set 2 Elements | | | |
|---|---|---|---|---|---|---|
| Iron | (30) Loft Angle (deg) | (40) Lie Angle (deg) | (36) Offset (in) | (38) Bounce angle (deg) | (42) Hosel Length (in) | (48) Blade Length (in) |
| 1 | 16 | 56 | 240 | −3 | 2.65 | 3.0 |
| 2 | 18 | 57 | 230 | −3 | 2.67 | 3.0 |
| 3 | 21 | 58 | 222 | −2 | 2.66 | 3.0 |
| 4 | 24.5 | 59 | 210 | −2 | 2.67 | 3.0 |
| 5 | 28 | 60 | 200 | −1 | 2.67 | 3.0 |
| 6 | 32 | 61 | 190 | −1 | 2.72 | 3.0 |
| 7 | 36 | 61.5 | 180 | −0 | 2.72 | 3.0 |
| 8 | 40 | 62 | 145 | +1 | 2.7 | 3.0 |
| 9 | 44 | 62.5 | 110 | +2 | 2.7 | 3.0 |
| PW | 48 | 63 | .095 | +4 | 2.75 | 3.0 |
| W | 52 | 63 | .095 | +4 | 2.75 | 3.0 |
| SW | 56 | 63 | +010 | +10 | 2.72 | 3.0 |
| LW | 60 | 63 | +010 | +8 | 2.70 | 3.0 |

TABLE B-2

| | | Club Set 2 | | | |
|---|---|---|---|---|---|
| Iron | (34) Top Line Thickness (in) | (62) Toe Sole Width (in) | (60) Heel Sole Width (in) | Head Weight (gram) | (28) Finished Club Length (in) |
| 1 | .270 | .885 | .590 | 235 | 39.5 |
| 2 | .270 | .910 | .605 | 242 | 39 |
| 3 | .270 | .910 | .605 | 247 | 38.5 |
| 4 | .270 | .920 | .640 | 253 | 38 |
| 5 | .270 | .920 | .640 | 260 | 37.5 |
| 6 | .270 | .925 | .650 | 267 | 37 |
| 7 | .270 | .940 | .680 | 274 | 36.5 |
| 8 | .270 | .940 | .680 | 282 | 36 |
| 9 | .270 | .990 | .695 | 286 | 35.625 |
| PW | .270 | 1.040 | .725 | 289 | 35.5 |
| W | .270 | 1.040 | .730 | 293 | 35.5 |
| SW | .270 | 1.060 | .810 | 293 | 35.5 |
| LW | .170 | 1.050 | .800 | 293 | 35.5 |

TABLE B-3

| | Club Set 2 | |
|---|---|---|
| Iron | Cavity Volume ($in_3$) | % Club Wt Toe/Sole |
| 1 | .73 | 50 |
| 2 | .68 | 52 |
| 3 | .77 | 50 |
| 4 | .74 | 52 |
| 5 | .67 | 53 |
| 6 | .62 | 56 |
| 7 | .59 | 56 |
| 8 | .71 | 57 |
| 9 | .66 | 57 |
| PW | .64 | 57 |
| W | .59 | 57 |

TABLE B-3-continued

| Iron | Club Set 2 Cavity Volume ($in_3$) | % Club Wt Toe/Sole |
|---|---|---|
| SW | .55 | 57 |
| LW | .54 | 57 |

TABLE C-1

| Iron | Loft | Lie | Club Set 3 Elements Offset | Bounce | Hosel | Blade L |
|---|---|---|---|---|---|---|
| 1 | 16 | 56 | .090 | +2 | 2.65 | 2.75 |
| 2 | 18 | 57 | .090 | +2 | 2.67 | 2.75 |
| 3 | 21 | 58 | .090 | +1 | 2.66 | 2.75 |
| 4 | 24.5 | 59 | .090 | +1 | 2.67 | 2.75 |
| 5 | 28 | 60 | .090 | 0 | 2.67 | 2.75 |
| 6 | 32 | 61 | .090 | 0 | 2.72 | 2.75 |
| 7 | 36 | 61.5 | .090 | +1 | 2.72 | 2.75 |
| 8 | 40 | 62 | .090 | +2 | 2.7 | 2.75 |
| 9 | 44 | 63 | .090 | +3 | 2.7 | 2.75 |
| PW | 48 | 64 | .090 | +4 | 2.75 | 2.75 |
| W | 52 | 64 | .090 | +4 | 2.75 | 2.75 |
| SW | 56 | 65 | +.010 | +10 | 2.72 | 2.75 |
| LW | 60 | 65 | +.010 | +8 | 2.70 | 2.75 |

TABLE C-2

| Iron | Topline | Toe | Club Set 3 Heel | Weight | Finished |
|---|---|---|---|---|---|
| 1 | 250 | .79 | .55 | 235 | 39.5 |
| 2 | 250 | .79 | .55 | 242 | 39 |
| 3 | 250 | .78 | .55 | 247 | 38.5 |
| 4 | 250 | .78 | .55 | 253 | 38 |
| 5 | 250 | .77 | .55 | 260 | 37.5 |
| 6 | 250 | .77 | .56 | 267 | 37 |
| 7 | 250 | .77 | .56 | 274 | 36.5 |
| 8 | 250 | .77 | .57 | 282 | 36 |
| 9 | 250 | .77 | .57 | 286 | 35.625 |
| PW | .250 | .77 | .57 | 289 | 35.5 |
| W | .250 | .77 | .57 | 293 | 35.5 |
| SW | .250 | .8 | .58 | 293 | 35.5 |
| LW | .250 | .8 | .58 | 293 | 35.5 |

TABLE C-3

| Iron | Club Set 3 Elements Cavity Volume ($in_3$) | Wt In Toe/Sole |
|---|---|---|
| 1 | .20 | 53% |
| 2 | .19 | 53% |
| 3 | .17 | 53% |
| 4 | .16 | 53% |
| 5 | .15 | 53% |
| 6 | .16 | 53% |
| 7 | .13 | 53% |
| 8 | .26 | 53% |
| 9 | .21 | 53% |
| PW | .20 | 53% |
| W | .20 | 53% |
| SW | | |
| LW | | |

The preferred ranges for the clubs of this invention are:

| Element | Range |
|---|---|
| Club Head Blade Length | 2.75"-3.2" |
| Face Thickness | .135"-.250" |
| Head Weight | 220 GM-310 GM |
| Sole Width (Toe) | .600"-1.25" |
| Sole Width (Heel) | .400"-.900" |
| Top Line Thickness | .190"-.300" |

-continued

| Element | Range |
|---|---|
| Cavity Volume | .015-.80 cubic inch |

While golfers may visualize the optional ball striking position as being the geometric center, through practice and habit many golfers consistently strike the ball away from such center horizontally toward the toe or heel or up or down toward the sole or top edge. Such striking propensity of a golfer or group of golfers has been found to be consistent for each club in the set. For example, a golfer who strikes (or causes ball impact) slightly inside (toward the heel) of the geometric center with the two iron, will also strike the ball inside with the three iron and so forth throughout the set.

Figure 11:
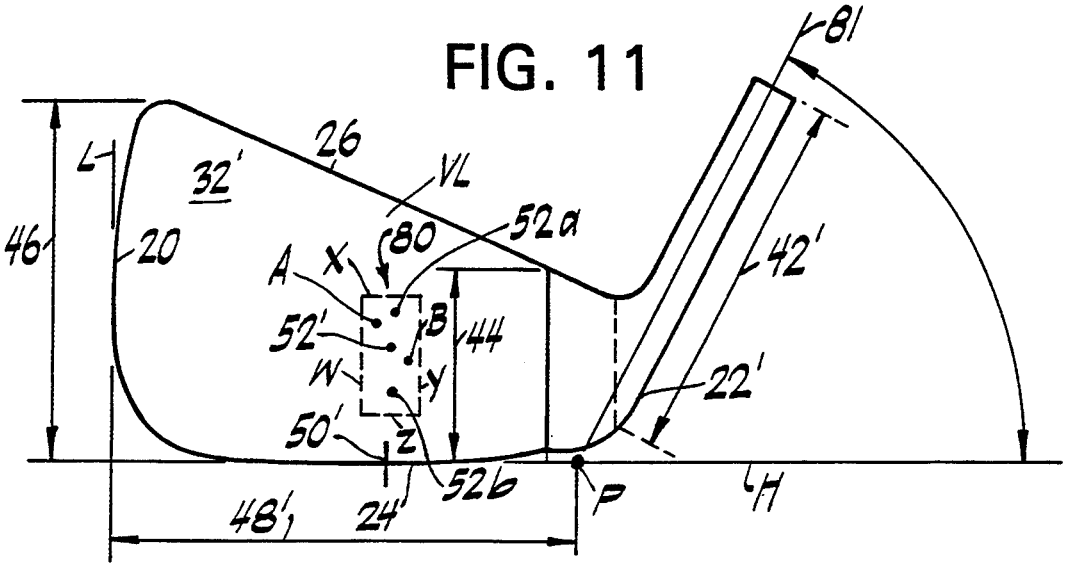
FIG. 11 is a front view of a club head illustrating a second embodiment of the invention.

Turning to FIG. 11, a second embodiment is shown, which together with the first embodiment, is directed to a method of making a series of sets of irons in which each set has specifically-located centers of gravity for each club in the set which centers of gravity coincide with or are spaced or are away from the geometric centers of each club. Directing attention to the club as shown in FIG. 11 the centers of gravity A and B are spaced from the geometric center 52' because centers of gravity A and B are intended positions of ball impact.

For a set of clubs to serve those golfers that strike the ball at the geometric center, each club in the set should have its center of gravity at the geometric center. Center 52' is located within geometric center area 80 outlined by dashed lines W, X, Y, and Z forming a rectangle similar to the first embodiment with vertical line VL along the surface of front face 32 with a reasonable deviation on either side. Line VL is projected upward from midpoint 50 of distance 48. Distance 48 is measured from (a) the intersection of hosel centerline 81 and the horizontal (H) (i.e. point P) to (b) the intersection of vertical toe line (L) and horizontal (H).

The first embodiment of the present invention serves the group of golfers who cause the ball to impact the geometric center along and near the center line VL as in FIG. 11 and in the first embodiment. Along line VL there is located center **52*a* which is one (1) inch up from sole 24' and center 52*b* which is 0.50 inch up from sole 24'**. Such first group of golfers can best utilize a set of clubs where each club head has a center of gravity at vertical line (VL).

The second embodiment is directed to those groups of golfers who hit away from the geometric center. For example, a group of less skilled golfers cause the club to impact the ball at point A, a short distance from VL (i.e. about three-eighths of an inch) toward the club toe and a short distance (i.e. one-quarter of an inch) above the center of gravity. If the club head center of gravity were located along line VL, this group of golfers would experience off-center shots. This group of less skilled golfers are best served by using club sets in which the center of gravity, through perimeter weighting, is located to coincide with ball impact point A (FIG. 11). Where, as here, each club head in a set varies in size and shape, to obtain perimeter weighting it is necessary that the perimeter of the club heads in a set differ in size and shape within the set. Likewise, a third group of more skilled golfers tend to cause club and ball impact at point B for each and every club in the set. Again, in accordance with the method of this invention, the center of gravity for this third category of golfers, requires that the center of gravity and position B coincide for more consistent shots.

Thus, the present invention permits a plurality of sets to be made using the teaching herein in which each set has a particular geometric center 52, 52' or a desired ball impact location A, B, where perimeter weighting, used to adjust the center of gravity to coincide with such geometric centers or impact locations. Directing attention again to FIGS. 5 and 6, continuous surface 90 is bordered by outer perimeter 91 and interior perimeter 92. Back cavity is defined by interior perimeter 92, wall 93 and bottom 96. Bottom 96 intersects continuously wall 93 and wall 93 intersects interior perimeter 92 (lower half 92*a* and upper half 92*b*) continuously without. Bottom 96 has substantially the same area as the area defined by and within interior perimeter 92.

While a set is usually irons 2–9 and wedges a set may include just one (1) or two (2) or more clubs such as a 2 iron or a PW and W. For example, where testing of a group of golfers or an individual reveals that point A is the impact point for the two iron and position 52 for the other irons, the group or individual would need two "sets" of irons.

Any conventional shaft and grip can be used with the club heads of the present invention. Best results have been obtained with True Temper shaft MS-209 and Golf Pride Victory half cord grip. Club heads are made of stainless steel or other metal of similar density.

The sweet spot is an area of ball impact on a club in which the distance and dispersion of the ball hit attains ninety-five percent (95%) of the optimum distance and dispersion for such club. The sweet spot for the club of FIG. 11 would in part overlap area 80.

It will be understood that the claims are intended to cover all changes and modifications of the preferred embodiment of the invention herein chosen for the purpose of illustration which do not constitute a departure from the spirit and scope of the invention.

What is claimed is:

1. A method for making a plurality of sets of irons with each set having cavity back club heads with geometric centers on their faces defined by a position on a vertical line comprising a) selecting a size and shape for each club face in the set;

b) determining for each club face the intended position of ball impact on each face;

c) forming a perimeter portion surrounding the back cavity for each club head, said perimeter portion defined by a continuous surface between a continuous outer perimeter and a continuous interior perimeter and sized and shaped to create, on the face, a selected center of gravity location;

d) the back cavity formed having a volume defined by i) said interior perimeter which perimeter defines an interior area within it;

ii) a continuous wall of variable depth which wall intersects with said interior perimeter through lower and upper halves, said wall having an area substantially equal to said interior perimeter area;

iii) a flat bottom substantially parallel to said club face;

said perimeter portion formation being such that the center of gravity of each club head coincides with the geometric center.

2. The method of claim 1 in which the center of gravity coincides with the geometric center for each club in the set.

3. The method of claim 1 in which the center of gravity is located a short distance from the geometric center toward the toe.

4. The method of claim 1 in which the center of gravity is located a short distance from the geometric center toward the heel.

5. An iron with a club head including a hitting face where the head comprises i) a club head blade having a length between 2.75 inches to 3.2 inches;

ii) a face thickness between 0.135 inch and 0.250 inch;

iii) a head weight between 220 grams and 310 grams;

iv) a sole width at the toe and at the heel between 0.600 and 1.25 inches;

v) a top line thickness between 0.190 inch and 0.300 inch;

vi) a back cavity having a volume between 0.015 cubic inch and 0.80 cubic inch and a shape defined by a a) continuous perimeter b) a flat bottom spaced from and forward of the continuous perimeter;

c) a continuous wall intersecting the perimeter and the bottom; and d) the area defined by the continuous perimeter and the area of the bottom being substantially the same.

* * * * *

UNITED STATES PATENT AND TRADEMARK OFFICE
CERTIFICATE OF CORRECTION

PATENT NO. : 5,429,353

DATED : July 4, 1995

INVENTOR(S) : John B. Hoeflich

It is certified that error appears in the above-identified patent and that said Letters Patent is hereby corrected as shown below:

In column 1, line 4, insert --This application is a continuation-in-part of U.S. patent application Serial No. 07/972,039, filed November 5, 1992, now abandoned, which is a continuation of U.S. patent application Serial No. 07/711,323, filed June 6, 1991, now abandoned.--.

Signed and Sealed this

Fourteenth Day of January, 1997

Bruce Lehman

*Attest:*

BRUCE LEHMAN

*Attesting Officer*

*Commissioner of Patents and Trademarks*